US008474207B1

(12) United States Patent
Gilbert et al.

(10) Patent No.: US 8,474,207 B1
(45) Date of Patent: Jul. 2, 2013

(54) STRENGTHENING WOOD FRAME CONSTRUCTION AGAINST WIND DAMAGE

(76) Inventors: John A Gilbert, Huntsville, AL (US); Thomas N Lavin, Watchung, NJ (US); Houssam Toutanji, Madison, AL (US); David J. Alldredge, Owens Cross Roads, AL (US)

( * ) Notice: Subject to any disclaimer, the term of this patent is extended or adjusted under 35 U.S.C. 154(b) by 0 days.

(21) Appl. No.: 13/494,823

(22) Filed: Jun. 12, 2012

(51) Int. Cl.
*E04C 1/00* (2006.01)

(52) U.S. Cl.
USPC ..... 52/309.1

(58) Field of Classification Search
USPC ..... 52/309.1, 309.2, 309.13, 90.1, 92.1, 52/92.2, 93.1, 712
See application file for complete search history.

(56) References Cited

U.S. PATENT DOCUMENTS

| | | | | |
|---|---|---|---|---|
| 3,479,071 | A * | 11/1969 | Downing | 403/384 |
| 5,342,904 | A * | 8/1994 | Hefner et al. | 525/488 |
| 5,487,241 | A * | 1/1996 | Gorrell et al. | 52/79.1 |
| 5,498,460 | A | 3/1996 | Tingley | |
| 5,736,220 | A * | 4/1998 | Tingley | 428/114 |
| 6,490,834 | B1 | 12/2002 | Dagher | |
| 6,806,212 | B2 * | 10/2004 | Fyfe | 442/104 |
| 6,808,788 | B2 | 10/2004 | Bogner | |
| 7,547,470 | B2 | 6/2009 | Gardner et al. | |
| 8,087,210 | B2 | 1/2012 | Agneloni | |
| 2003/0150189 | A1 * | 8/2003 | Ou et al. | 52/784.1 |
| 2008/0051233 | A1 * | 2/2008 | Nesbitt et al. | 473/602 |
| 2008/0092731 | A1 * | 4/2008 | Hall | 89/36.04 |
| 2008/0295453 | A1 * | 12/2008 | Carlson et al. | 52/841 |
| 2008/0313985 | A1 * | 12/2008 | Duncan | 52/309.1 |
| 2009/0151273 | A1 * | 6/2009 | Axsom | 52/167.1 |
| 2011/0197527 | A1 * | 8/2011 | Ingham et al. | 52/302.1 |
| 2011/0313084 | A1 | 12/2011 | Furar et al. | |

FOREIGN PATENT DOCUMENTS

| | | | |
|---|---|---|---|
| JP | 11130834 A | * | 5/1999 |
| WO | PCT/IT2006000070 | | 2/2006 |

OTHER PUBLICATIONS

D. Alldredge et al, Structural Enhancement of Framing Members using Polyurea, Annual Proceedings of the Society. f. Experimental. Mechanics (SEM), Jun. 13-16, 2011, paper # 143.

R.A. Grigsby, Polyurea RIM—A Versatile High Performance Material, J. of Elastomers & Plastics, vol. 18, Apr. 1986, p. 71-84.

T.D. Hrynyk et al, Out-of-Plane of URM Arching Walls w/ Modern Blast Retrofit, J. Structural Engineering, Oct. 2008, p. 1589-1597.

L.G. Moradi et al, Resistance of Membrane Retrofit Concrete Walls to Lateral Pressure, J. Performance of Constructed Facilities, May/Jun. 2008, p. 131-143.

T.D. Reed et al, Uplift Capacity of Light-Frame Rafter to Top Plate Connections, J. of Architectural Engineering, Dec. 1997, p. 156-163.

C.M. Roland, High Strain Rate Mechanical Behavior of Polyurea, Polymer, vol. 48, 2007, p. 574-578.

M.F. Sonnenschein et al, Two-Phase Composite Modeling of Polyurea / Wood Interfaces, J. of Applied Polymer Science, vol. 113, issue 3, Aug 5, 2009, p. 1739-1744.

* cited by examiner

*Primary Examiner* — Mark Wendell
*Assistant Examiner* — Keith Minter
(74) *Attorney, Agent, or Firm* — Karin A Bartels

(57) ABSTRACT

This invention provides for reinforced wood structures including framing members and a method to reinforce the connection between structural members to increase the load bearing capacity of framing member intersections by covering the intersecting wood framing members with a layer of a liquid elastomer including polyurea.

14 Claims, 7 Drawing Sheets

STRENGTHENING WOOD FRAME CONSTRUCTION AGAINST WIND DAMAGE

This work was supported by the U.S. Department of Commerce under NOAA SBIR Phase I and Phase II contract no. WC133R-09-CN-0108.

FIELD OF INVENTION

This invention relates in general to strengthening wood-frame construction, and in particular, to a method of reinforcement of wood-frame construction designed to increase its resistance to high winds or earthquakes by applying a reinforcement coating comprising polyurea to the wood-frame.

BACKGROUND OF INVENTION

A very common building structure is based on wood-framing connection using framing members tied to the foundation or roof, and framing members attached to other framing members with fasteners. Recently, building codes recommend reinforcement of building structures using metal ties or metal straps between the framing member and the roof structure. While this building practice has performed well, damage to building structures due to high energy stresses such as hurricanes, tornados and earthquakes is a constant unmitigated occurrence.

It is evident that significant problems exist in building constructions located in coastal areas and in tornado prone areas. There is a need for reinforcement materials and techniques that reinforce new and existing structures while providing safety for building occupants. Surveys show that a significant portion of the damage resulting from hurricanes and earthquakes occurs in the connection between the roof and the wall of the building due to excessive deformation and movement of structures. In particular, the connection between the roof rafter or truss and the top plate is critical for the uplift force applied by high-wind events such as hurricanes. To increase the uplift capacity of rafter to top plate connections, building code provisions describe reinforcing them by using methods including toe nailing, metal straps and adhesives such as epoxies. Surveys also indicate problems with practices used to tie and strengthen framing members to the foundation or roof, and framing member to framing member. For example improper connections are made between the walls and the roof including but not limited to improper toenailing the rafter to the top plate. Missing or improper attachment of metal straps such as hurricane ties, are further examples of poor construction practices resulting in significant damage of the roof to wall connection and the sill-band joist-sole plate connection. Therefore, there is a need for a simple and improved construction method to reinforce conventional building structures. A desirable construction method should increase the strength and reduce the deformation of wood structures to restrict or eliminate the damage of framing member connections.

In the past, reinforcement methods have been applied to wood structures that include coatings and adhesives. Reinforcement of wood member joints has been achieved using a variety of connecting means including metal straps and epoxy adhesives. U.S. Pat. No. 5,501,054 to Soltis discloses a multi-layer fiber reinforcing material and an epoxy resin coating to reinforce wood members. However, the application of the adhesive and fiber directly to wood member joints during the building construction or by retrofitting an existing structure by adding wooden blocks to the wood connection is an expensive and difficult process.

A common problem in the application of coatings to wood structures is the rather small increase in wind uplift capacity such as dosed-cell polyurethane foam to avoid framing member deformation or even failure. US published Pat. Appl. No. 2008/0313985 to Duncan provides a method for increasing the wind uplift resistance of wood-framed roofs and side-wall structures using closed-cell polyurethane foam. An increase of uplift capacity is obtained by applying a 3 inch or more thickness of polyurethane foam covering the entire roof sheathing and side walls. The polyurethane foam produced a rather moderate increase in wind uplift capacity. It is also known to the artisan in the art that polyurethane generally exhibits an inferior elongation before failure, and also an inferior heat stability compared to most polyurea resins. Thus, often complex multi-layer resins and composites and textile and/or fiber embedded resins are needed to achieve building structures that show an increase in energy absorption capacity. For example, U.S. Pat. No. 8,087,210 to Agneloni discloses applying several layers of elastic materials and additional fiber containing material film to a building structure to achieve some reinforcement. Typical Polyurea that is commercially available typically has a tensile strength range between 8.3 MPa and 45 MPa, and an elongation at break between 100% and 1000%.

It would be desirable to develop a reinforcement method containing a field or factory applied elastomer without any fiber reinforcement materials for improving the wind load-bearing capacity and deformation energy of wood member joints of a building structure.

SUMMARY OF THE INVENTION

It is one aspect of the present invention to provide a wood structure that has a tensile and torsional bearing capacity when subjected to increased loads at framing member intersections. The wood structure comprises framing members and in particular the connection between structural members.

In another aspect, the present invention provides an improved reinforcement coating for framing members and the connection between framing members. Reinforcement coatings may include any suitable polymer with sufficient adhesion to wood, tensile strength, elongation and thermal stability. Such coatings may include polyurea or polyurethane. The reinforcement coating includes polyurea that is applied to the framing member by spraying a single layer of polyurea onto the member including the member joint. In one embodiment, the polyurea coating comprises a blend of two precursor components comprising a diisocyanate and a polyamine. The coating is applied with a two cartridge cold spraying device. The sprayer mixes the two components in the correct ratio and the mixed components begin to gel into polyurea almost immediately. Polyurea is applied in a sufficiently reinforcing thickness and the thickness is at least 0.5 mm. The polyurea coating does not require any fibers or textile reinforcing materials.

The present invention further includes a method for increasing the strength of intersections of framing members also called joints between framing members in a wood frame by covering at least a portion of the intersecting wood framing members with a liquid coating comprising polyurea. In certain embodiments, the polyurea coating has a tensile strength from about 15 MPa to about 43 MPa and an elongation of about 100% to about 800%. The average thickness of the coating is about 1.0 mm to about 2.5 mm for polyurea resins having elongations of about 100% to about 800%. The coating comprises applying the coating liquid to the framing members by spraying, substantially coating all exposed surfaces of the framing member joint which is attached to at least one other framing member.

Various objects and advantages of this invention will become apparent to those skilled in the art from the following detailed description of the preferred embodiments.

DETAILED DESCRIPTION OF THE INVENTION

Figure 1:
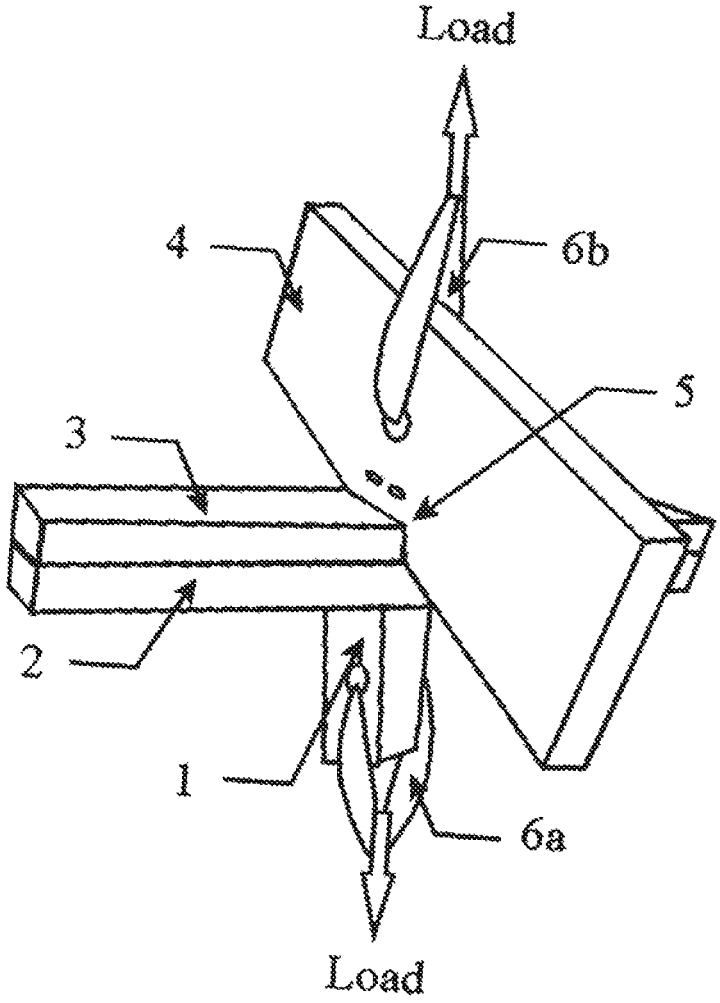
FIG. 1 is a view of the wall stud-top plate-rafter configuration with the pull straps attached to the wall stud and to the rafter as is used in the pull tests for the determination of the load failure for the wall stud-rafter connection.

The present invention provides for the strengthening of a wood structure comprising a plurality of framing members with a liquid coating and a method of application of the coating for reinforcing structures including but not limited to buildings, bridges, walls and floors to increase the resistance to unusual forces. For example, unusual forces are generated by high shear forces from gale-force winds or hurricanes exceeding wind speeds of more than 70 mph, significantly increasing the uplift forces of framing member structures and causing extensive damage such as large deformation of the framing member connections and sometimes destruction of the roof framing structure.

The preferred material for the structural members is wood including but not limited to primarily softwood from coniferous species including pine, fir and spruce, cedar, and hemlock, as well as hardwood including but not limited to ash, aspen, birch, cherry, mahogany, maple, oak, and teak. While not the preferred embodiment of the invention laminate and other wood composites are considered within the scope of the invention.

Structural members of a building structure are beams that are typically dimensional lumber made from softwood, engineered wood or formed steel. The structural members include but are not limited to studs, top plate, double top plate, rafters, sills, band joists and the like. Structural members intersect to form a frame for wood structures. Such intersections may be referred to as joints of the wood frame. Wood is the preferred structural member in this invention and Southern Pine is the most preferred wood. While not the preferred embodiment of the invention laminate and other wood composites are considered within the scope of this invention. In certain embodiments, the framing members comprise roof rafter to top plate connections and wood stud to top plate connections.

In further embodiments, the wood members are connected at their joints by fastening means including but not limited to nails, screws, bolts, and metal straps. Optionally, a wood member joint connected with fasteners may be additionally secured with a metal strap connecting, for example the roof rafter to the top horizontal wall plate. The metal straps may include but is not limited to hurricane straps and are widely known by the artisan of wood-framing construction such as Simpson ties or the like.

A stud is the vertical piece of lumber in the wall, the top plate forms the top of the wall and is typically doubled by doubling two studs that are connected perpendicular to the stud. A rafter is one of a series of sloped structural members or beams that extend from the ridge to the wall plate, and that are connected to the top plate with a bird's mouth. The connection of the top plate to the rafter is made by using fasteners by means of toenailing. Generally, toenailing is the nail connection of two wood framing members in the plane of an adjacent member at right angles to each other.

Typical wood members for framing structures include but are not limited to lumber that has a nominal cross sections of 2" by 3", 2" by 4", 2" by 6", 2 by 8", 2" by 10" or 2" by 12".

In a preferred embodiment of the invention, the framing members of this invention are a first wood member, a second wood member connected perpendicular to the first wood member, and a third wood member connected to the second wood member forming a framing configuration consisting of stud, top plate and rafter. Alternatively, framing members consisting of the band joist-sill joist-stud framing configuration are included in this invention.

The stud, top plate and rafter are connected with fasteners using commons nails: 16d nails were used to connect the 2"×4" stud to the bottom of the double top plate, and to connect the 2"×8" rafter having a bird's mouth to the top plate using a toenailing fastening method.

Reinforcement coatings may include any suitable polymer with sufficient adhesion to wood, tensile strength, elongation and thermal stability. Such coatings may include polyurea or polyurethane. The preferred coating includes a single polymerized layer of an elastomer including polyurea. The selected resin is preferably one that cures without addition of heat and without evolving solvent vapors so that it can be applied during the construction of a building or retrofitting an existing building. Resins that generally cure within these limitations are two-component system that crosslink when the two components are mixed. The preferred resin is polyurea. The precursor components of polyurea include isocyanate and a polyamine. The isocyanate component of the polyurea preferably is a diisocyanate, and may be any of the wide variety of diisocyanates available to the resin art and widely used in the production of polyurea resins. Typical diisocyanates suitable for the use with polyurea include aliphatic diisocyanate including but not limited to isophorone diisocyanate (IPDI), hexamethylene diisocyanate (HMDI) and the like, and aromatic diisocyanates including but not limited to methylene diphenyl diisocyanate (MDI), toluene diisocyanate (TDI) and the like.

Aliphatic diisocyanate are preferred, and isophorone diisocyanate is most preferred. Aliphatic diisocyanates generally react instantly with the polyamine component upon mixing the 2 components. The polyamine component of the polyurea is at least one member selected from a group consisting of diethyltoluenediamine, polyoxypropylenediamine and 4,4-methylenebis(N-sec-butylamine). The most preferred polyamine is polyoxypropylenediamine.

Optionally, the polyurea resin of this invention may further include additional additives such as stabilizers, viscosity modifiers, thickeners, dyes, pigments and other processing aids. Such additives will be selected and compounded with the resin in amounts according to methods and principals well-known and understood by those skilled in the art.

Conventional application methods may be used to coat the polyurea resin on the surfaces and joints of the wood member structure using any suitable application device including but not limited to spraying, brushing, rolling, dipping, and applying a viscous semi-solid extrudable liquid and other methods known to the art. The preferred coating method is spraying. Commercially available sprayers may be used to spray the coating, such as a low-pressure cartridge sprayer or a high pressure sprayer. The sprayer used was a Voyager type low-pressure sprayer obtained from Creative Material Technologies Ltd. and had a spray pattern of about 4 inches. The low-pressure sprayer pumps and mixes polydiisocyanate and polyamine (the two components) into a mixing chamber of the sprayer in the stoichiometric correct ratio forming the polyurea and spraying the polyurea onto the wood structure configuration. The polyurea may gel in less than 90 seconds. In the case of the application of a viscous semi-solid extrudable liquid the gelling time may be extended considerably. The preferred gelling time when using a sprayable polyurea is about 60 sec or less.

The coating comprises of applying the coating liquid to the framing members by spraying, substantially coating all exposed surfaces of the framing member joint attached to at least one other framing member. To describe the coverage of the polyurea to the wood member intersection it is necessary to describe both the coverage of the intersection itself and the distance away from the intersection that is covered by the polyurea. The wood framing members are coated a distance away from the joint between two wood members. This distance from the intersection of the two wood members is preferably about 5 cm to about 7 cm, and will vary in practice depending on the spray geometry of the spraying device used. Preferably the coverage of the intersection between the wood members is covered is at least 65% of the intersection.

While not the preferred embodiment of this invention, included in this invention is the practice of coating the wood framing structure of a building entirely or other parts of the framing structure with the polyurea coating. For example, the foundation to floor connection such as the sill band joist-sole plate-wall stud connection may be similarly strengthened. In another preferred embodiment the coating forms a single polymerized layer.

The wall stud-top plate-rafter configuration used for all pull tests as described below in Examples 1 to 5 was coated with polyurea having an average thickness of about 1.5 mm to about 2.5 mm depending on the mechanical properties of the polyurea.

In certain embodiments, the coating of the member configuration connected with fasteners and optionally reinforced with hurricane ties is applied preferably at a thickness from about 1.5 mm to about 2.5 mm, and most preferably from about 2.0 mm to about 2.5 mm. The thickness measurements were performed before and after the nailed specimen were sprayed with the coating resin using a dial thickness gauge having an accuracy of ±0.0025 mm. The average value of the coating thickness was obtained for all of the coated configurations by making measurements in two different directions: 1) across the thickness of the rafter at a point located midway between the centerline of the upper hole and the upper surface of the top plate, and 2) across the smaller dimension of the lower 2" by 4" at a point located midway between the centerline of the lower hole and the lower surface of the top plate.

Polyureas have a wide range of physical properties and chemistries. The artisan in the elastomer art may select other polyurea products and application thicknesses and application areas which produce a suitable strengthening of wood frame member connections. In the present invention two randomly selected polyurea resins were used to demonstrate the strengthening results of framing structures.

In certain embodiments, the polyurea coating has a tensile strength from about 15 MPa to about 43 MPa and an elongation of about 100% to about 800%. The preferred tensile strength is from about 15 MPa to about 20 MPa, and the most preferred tensile strength is from about 15.0 MPa to about 15.2 MPa.

EXAMPLES

General Protocol for Pull Test Load/Displacement Tests

The load/displacement tests to determine the strain energy measured as the area under the load-displacement curve were performed in accordance with the standard test for testing mechanical fasteners in wood, such as ASTM D1761 with the exception that the test was performed in a displacement controlled manner as opposed to a load control as described in ASTM D1761. All load/displacement tests were performed using a Material Testing System (MTS) machine with a maximum load rating of 98 kN and equipped with a load cell. The pull tests for all framing member configurations were accomplished by pulling the configuration beyond the peak load in order to determine the strain energy to failure.

Figure 4:
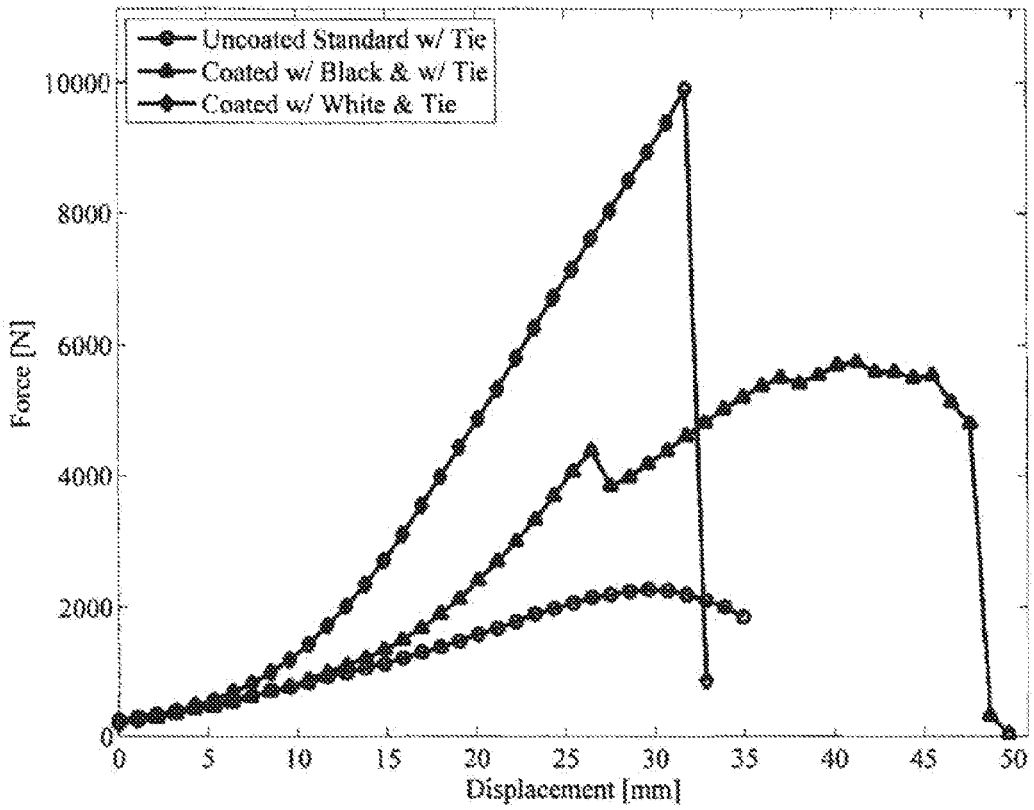
FIG. 4 is a graph showing the load versus deflection test for a 2" by 4" wood stud-top plate-rafter connection, comparing the uncoated and coated both reinforced configurations with a metal tie. Two different polyureas were used as the coating.
Figure 5:
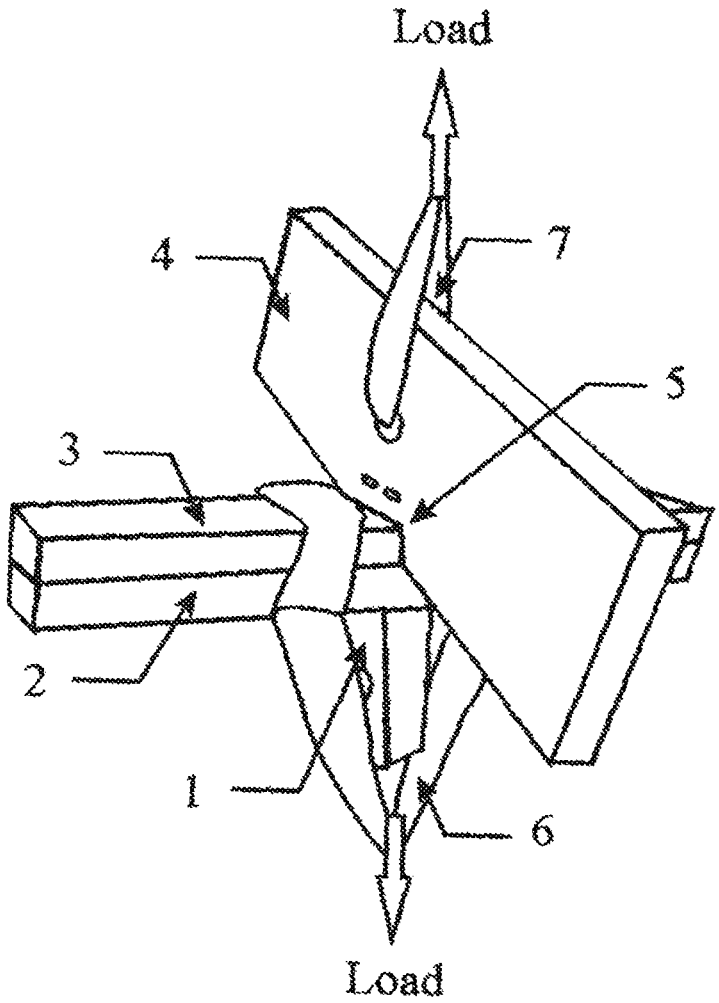
FIG. 5 is a view of the waif stud-top plate-rafter configuration with the pull straps around the top plate and attached to the rafter used in the pull tests for the determination of the load failure for the top plate-rafter connection.

FIG. 1 shows the view of a wall stud to rafter connection used in the pull tests with the wall stud 1 connected to the two top plates 2 and 3 which are connected to the rafter 4 with a bird's mouth 5. The specimens were placed in uniaxial tension by passing Keviar straps 6*a* and 6*b* through two 2.34 cm diameter holes drilled in the center of the 2"×4" stud 1 and the rafter 4. Each hole was reinforced using a 3.8 cm long section of aluminum pipe. A pull rate of 12.7 mm/min was applied and pulled beyond the peak load to failure. This configuration as shown in FIG. 1 was employed in FIGS. 2 to 4 and Examples 2, 3 and 4. The configuration as shown in FIG. 5 was used in Example 5 and FIG. 6.

Example 1

Test for Net Deflection of Pull Straps

Using the described protocol a control test was performed to determine the net deflection of the pull straps. This test is necessary to correct for the strain energy imposed on the pull straps and to allow corrections to be made on true failure forces of the specimen tested. A net deflection for each configuration was calculated by subtracting the deflection in the pull straps from that measured for the crossheads.

Example 2

Control Test for Stud-Top Plate-Rafter Configuration Uncoated

Figure 2:
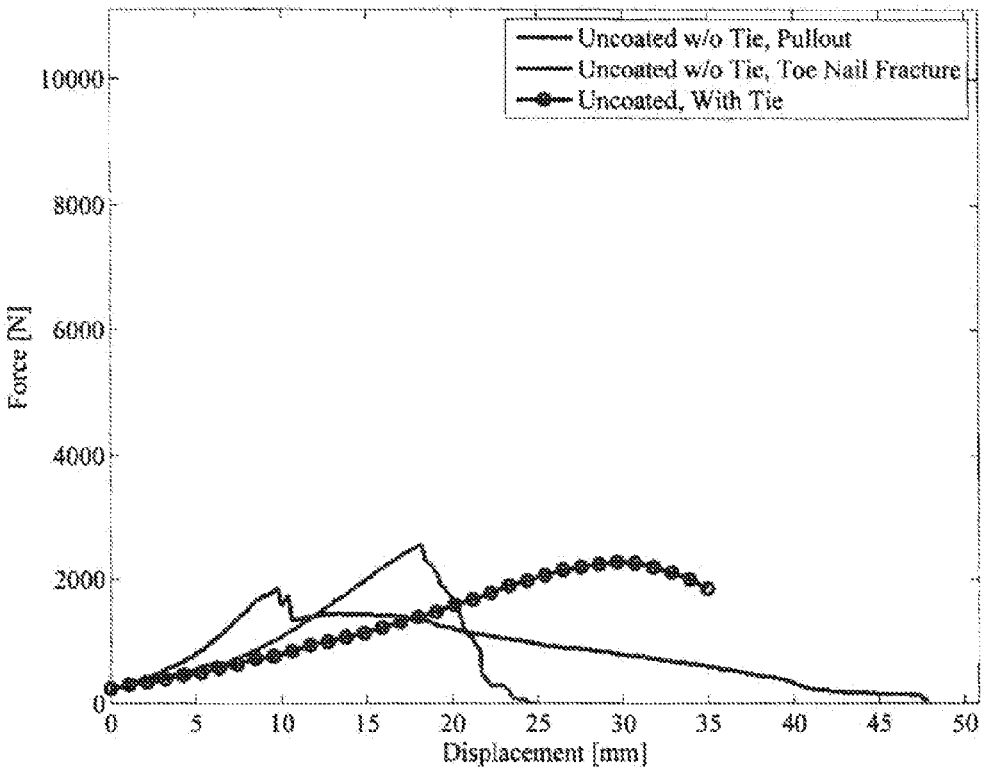
FIG. 2 is a graph showing the load versus deflection test for a 2" by 4" wood stud-top plate-rafter connection, comparing the uncoated configuration with and without a hurricane tie.

According to the described pull test load/displacement protocol, three uncoated stud-top-plate-rafter configurations were subjected to the load versus deflection test. Two of the configurations were fastened with nails only. One configuration was fastened with nails and additionally with a hurricane tie fastened between stud and the rafter with fourteen 4d nails. FIG. 2 displays the results of the load/displacement test of the two configurations. One of the configurations using nails as connectors commonly failed gradually as the nails in the top plate pulled out of the stud (FIG. 2 uncoated w/o tie, pullout). The maximum load for this uncoated configuration was 1851 N and defined as the test standard for 2" by 4" end nail failure; i.e. pull out between the stud and top plate in an unreinforced configuration. Another configuration was fastened with nails and a metal tie, e.g. Simpson LTS12 hurricane tie as an additional reinforcement. The failure occurred when the tie deformed as the nail farthest away from it pulled out of the stud (FIG. 2 uncoated with tie). The specimen held a maximum load equal to 2277 N which was considered "standard" for pull out failure of an uncoated, reinforced configuration, as shown in FIG. 2. This mimics the uplift load to the roof rafters as found during hurricane wind loadings.

Example 3

Pull Test for Load Failure of Stud-Top Plate-Rafter Configuration Coated with Polyurea According to the described pull test protocol, two stud-top plate-rafter configurations were coated with two types of polyurea and subjected to the load/deflection test. Polyurea type A is a black pigmented polyurea having an elongation of 797% with a relative low elastic modulus and a tensile strength of 16 MPa, such as Dyna-Pur 1137. Polyurea type B is a white pigmented polyurea having an elongation of greater than 100% with a relative high elastic modulus and a tensile strength of 43 MPa, such as Dyna-Pur 8817.

Both the black and white pigmented polyurea are commercially available from Creative Materials Technologies (Type 1137, an aromatic polyurea for the black polyurea and Type 8817, an aliphatic white polyurea). The two types of polyurea were used for the coated specimen in all pull tests to determine the strain energy. The net strain energy is equal to the work done as the load is slowly applied and represents the amount of energy required to bring each configuration to the maximum load condition.

Figure 3:
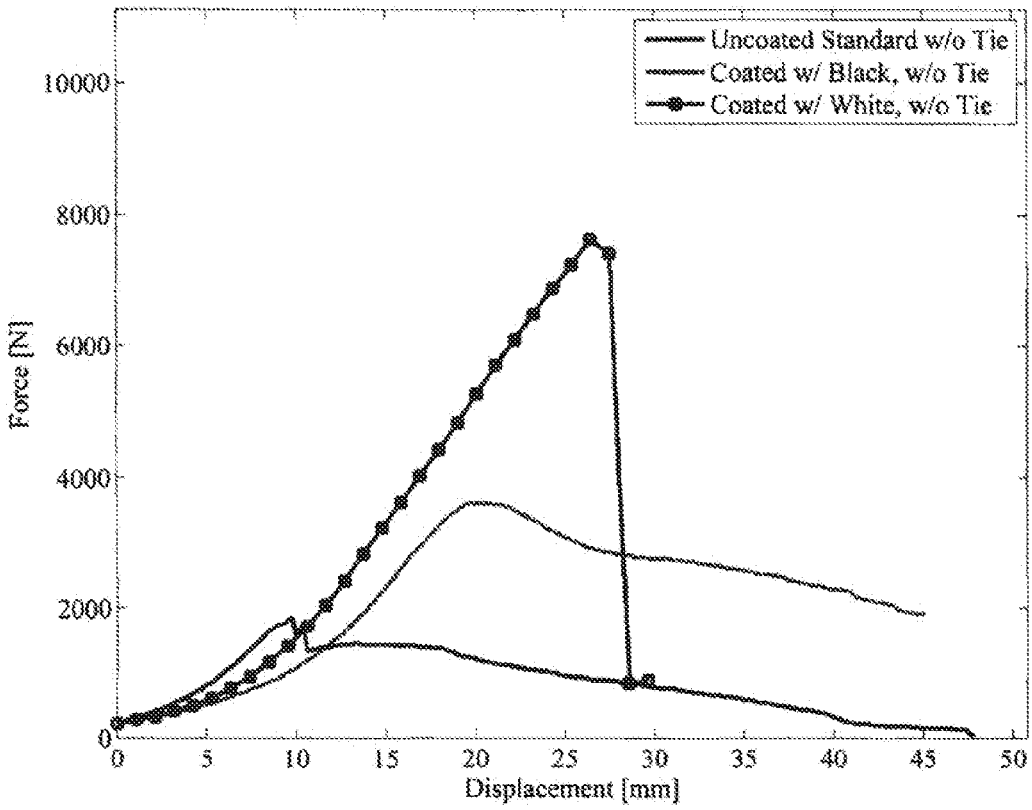
FIG. 3 is a graph showing the load versus deflection test for a 2" by 4" wood stud-top plate-rafter connection, comparing the polyurea coated configurations and uncoated configuration without a hurricane tie.

For comparison, the standard stud-top plate-rafter configuration fastened together with nails only was tested and gave a maximum load of 1850 N. The maximum load for the specimen coated with the black pigmented polyurea was 3621 N whereas the maximum load for the specimen coated with the white pigmented polyurea was much higher at 7624 N as shown in FIG. 3 and Table 1.

The failure of the stud-top-plate-rafter connection occurred relatively slowly in the configuration coated with the black polyurea as compared to the white-coated configuration which failed quickly after wood fibers fractured in the top plate. Overall the polyurea coated framing member configurations exhibited higher strain energy.

The maximum loads that the three different specimens without hurricane ties took along with the value of total deflection at which they occurred and the total strain energy required to achieve the maximum load condition is shown in Table 1. The net deflection and strain energy for each configuration was obtained by subtracting the values associated with the pull straps. The strain energy that is calculated is the area under the load/deflection curve as shown in FIG. 3.

TABLE 1

Maximum load and deflection for coated and uncoated 2" by 4" stud to rafter failure without hurricane tie

| Configuration Status | connector | Max. Load @ Pmax (N) | Net Deflection @ Pmax (mm) | Net Strain Energy to Pmax (N mm) |
|---|---|---|---|---|
| standard uncoated w/o tie | nails | 1850 | 8.1 | 7231 |
| coated w/ black PUR w/o tie | nails | 3621 | 16.8 | 23274 |
| coated w/ white PUR w/o tie | nails | 7624 | 20.1 | 57167 |

PUR = polyurea;
Pmax = strain energy to failure

Example 4

Pull Test for Load Failure of Stud-Top Plate-Rafter Configuration Coated with Polyurea and Using Hurricane Ties A second pull out test with hurricane tie reinforcement was performed testing the 2" by 4" end nail failure of the stud-top plate-rafter configuration, e.g. Simpson LTS12 hurricane tie. The tests with the three configurations were fastened and reinforced in the same manner. The standard configuration reinforced with a tie was used as the control. One configuration was coated with the black pigmented polyurea (Dyna-PUR 1137), and the second configuration was coated with the white pigmented polyurea (Dyna-PUR 8817). Overall, the addition of a polyurea coating allowed the reinforced configurations to withstand a significantly higher load.

The results of the maximum load and the deflection at failure are shown in Table 2.

TABLE 2

Maximum load and deflection for coated and uncoated 2" by 4" stud to rafter failure with hurricane tie

| Configuration Status | connector | Max. Load @ Pmax (N) | Net Deflection @ Pmax (mm) | Net Strain Energy to Pmax (N mm) |
|---|---|---|---|---|
| control - uncoated no tie | nails | 1850 | 8.1 | 7231 |
| standard - uncoated w/ tie | nails and tie | 2277 | 27.7 | 33668 |
| coated w/ PUR type 1137 (black) w/ tie | nails and tie | 5738 | 36.6 | 99648 |
| coated w/ PUR type 8817 (white) w/ tie | nails and tie | 9901 | 23.4 | 80102 |

PUR = polyurea;
Pmax = strain energy to failure

The strain energy was calculated by measuring the area underneath the force/displacement curve. The results for the coated and hurricane tie-reinforced configuration range from 9901 N for the white polyurea coated specimen to 5738 N for the black polyurea coated specimen, as compared to 2277 N for the standard uncoated configuration that was nailed and reinforced with a tie. The configuration coated with the white polyurea is able to withstand a 4.35 times higher maximum load and a 2.4 times higher strain energy at the maximum load. The configuration coated with the black polyurea is able to withstand a 2.52 times higher maximum load and a 3 times higher strain energy at the maximum load.

Example 5

Test for Failure of Top Plate to Rafter Configuration Coated with Polyurea

In a modification of the original pull test protocol a partial configuration was tested. As shown in the drawing FIG. 5 the double top plate 2 and 3 is connected to the rafter 4 by using a bird's mouth toe-nail 5 fastening method without a hurricane tie. Stud 1 is not included in this test configuration. One pull strap 6 was placed around the top plate 3 and the other pull strap 7 through the hole in the rafter 4. Force was only applied between the top plate and the rafter.

Figure 6:
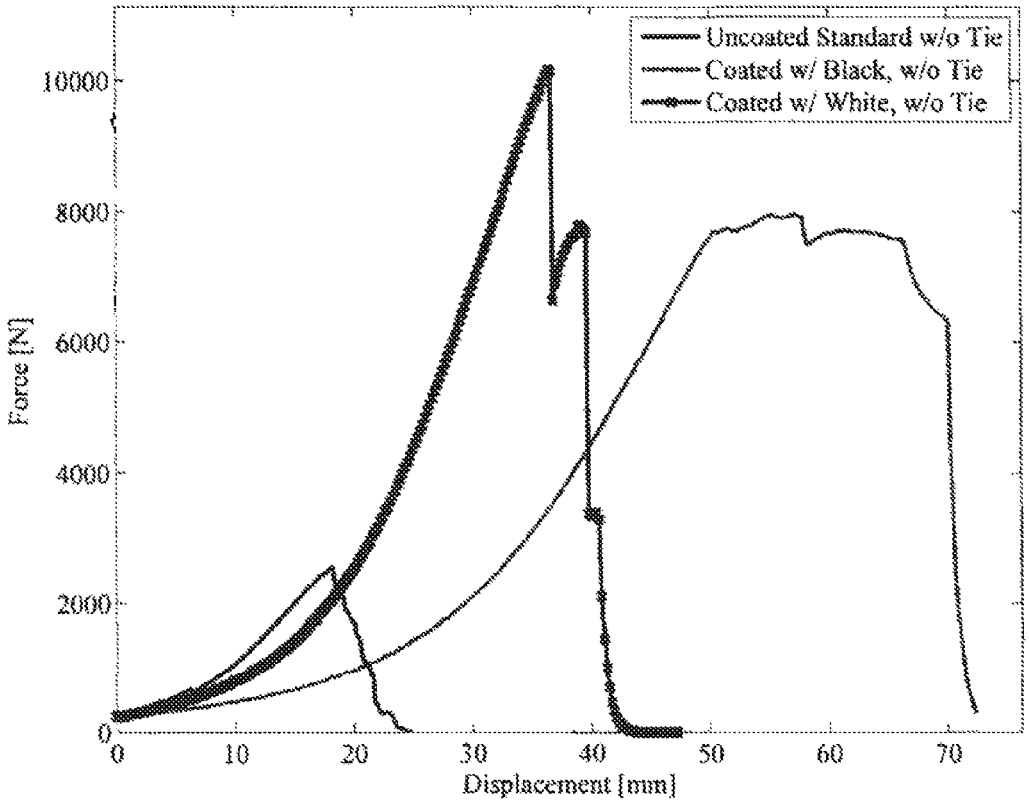
FIG. 6 is a graph showing the load versus deflection test for a 2" by 4" wood stud-top plate-rafter connection of the uncoated standard and the coated configurations coated with black and white polyurea.

Three specimens were tested according to this modified pull test: all three specimens in a standard configuration were fastened together with nails without a hurricane tie. One configuration was coated with the black pigmented polyurea (Dyna-PUR 1137), the second configuration was coated with the white pigmented polyurea (Dyna-PUR 8817) and the third was left untreated. The specimens were then pulled apart in tension with uplift force as shown in FIG. 5. The maximum load for the specimen coated with the black pigmented polyurea was 7949 N whereas the maximum load for the specimen coated with the white pigmented polyurea was much higher at 10164 N, and for the untreated toe-nail configuration was only 2562 N as shown in FIG. 6 and Table 3.

The failure results for the coated versus uncoated top plate to rafter configurations without the hurricane tie are summarized in Table 3.

TABLE 3

Failure results for coated versus uncoated top plate-rafter configurations without hurricane tie

| Configuration | Maximum Load @ Pmax (N) | Net Deflection @ Pmax (mm) | Net Strain Energy to Pmax (N mm) |
|---|---|---|---|
| standard (uncoated) | 2562 | 16.3 | 18077 |
| coated w/ PUR type 1137 (black) | 7949 | 48.5 | 129248 |
| coated w/ PUR type 8817 (white) | 10164 | 27.7 | 75922 |

PUR = polyurea;
Pmax = strain energy to failure

The results shown in Table 1, 2 and 3 show that the addition of a polyurea coating allowed the configurations with and without a hurricane tie can withstand a greater load. Failure results indicate that when compared to their uncoated counterparts, the black coated configurations were about two to three stronger whereas the white coated configurations were four to five times stronger. The strain energy was calculated by measuring the area underneath the force/displacement curve. The results shown in Table 1, 2 and 3 also show that the addition of a polyurea coating increases net deflection at Pmax by several 100%.

Example 6

Figure 7:
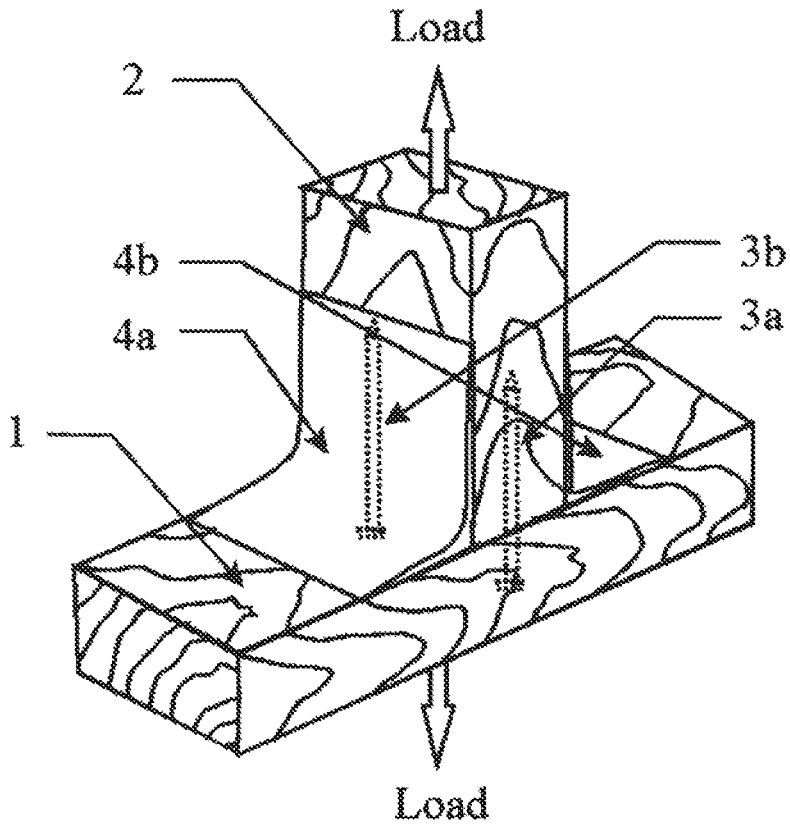
FIG. 7 is a view of the two 2" by 4" nailed T-joint connection with the polyurea coating on the two long sides of the joint intersection.

Test for Failure of T-joint Configuration with two 2" by 4" Wood Studs Additional pull tests were performed using a T-joint configuration as shown in FIG. 7 made using two 2" by 4" studs 1 and 2 where the end of the stud 1 is butted and fastened with two 16d nails 3*a* and 3*b* against the second stud 2 forming a 90 degree angle between the first and second stud 1 and 2. The coating is depicted as 4*a* and 4*b*.

14 specimens of T-joint configurations were constructed connecting the joints with 2 nails. The two uncoated wood studs used for the control differed in the wood grain in that the stud of specimen #1 had a courser grain than specimen #2 that exhibited a finer grain.

All coated T-joint specimens were coated with the white pigmented polyurea type 8817 having an elongation of 100% and a tensile strength of 43 MPa. As shown in FIG. 7, the joints were only coated on the two long sides 4*a* and 4*b* at the intersection of the cut wood stud 1 attached to the vertical 2" by 4" wood stud 2. This coating method differs from the previous used coating procedure for the stud-top plate-rafter configuration because the polyurea is applied to only two of the possible four sides of the connecting 2" by 4" wood members. The coating was applied by using the low-pressure sprayer holding the sprayer at a constant distance and spraying the polyurea until polyurea begins to flow. This coating method was used for the specimens 3 to 5, and 12 to 14 and dubbed as the nominal coating method. The attempt to generate a thin coat using the described coating method by trying to apply less polyurea was unsuccessful because the coating thickness essentially overlapped with the thickness of the nominal coating. The attempted thinner coating method is dubbed thin-coating. A coating method to create thicker coat as used for specimens 9 to 11 included a two-step coating procedure using the nominal coating method followed by a second coating after the first coat gelled.

The pull tests show the minimum coverage needed to coat the intersections of two wood studs to obtain a stronger joint and a higher load failure. The results of the pull test for the T-joint configuration are shown in Table 4.

TABLE 4

Pull Tests with uncoated versus coated 2" by 4" T-joint configuration

| specimen | connector | coating procedure | coating thickness [mm] | failure load [N] |
|---|---|---|---|---|
| 1 | nails | uncoated | 0 | 1765 |
| 2 | nails | uncoated | 0 | 2134 |
| 3, 4, 5 | nails | coated - nominal | 0.51-0.76 | 3516 |
| 6, 7, 8 | nails | coated - thin | 0.38-0.76 | 3682 |
| 9, 10, 11 | nails | coated - thick: nominal coating, allow to gel, add $2^{nd}$ coating layer | 1.02-1.52 | 2684 |
| 12, 13, 14 | nails | coated - nominal | 0.51-0.76 | 3936 |

The maximum load that the polyurea coated T-joint configuration can withstand until failure is about 3516 N to about 3936 N. Compared to the uncoated T-joint configuration, the load bearing capacity increases from 200% to 223% was observed for a polyurea thickness of 0.38 mm to 1.52 mm coated only along the two long joint intersection of two 2" by 4" wood studs as shown in FIGS. 7, 4*a* and 4*b*.

DISCUSSION

A review of the load/deflection graphs in shown in FIGS. 2, 3, 4, and 6 reveal that the peaks corresponding to the maximum load in the coated polyurea configurations always occurred at a greater deflection than those corresponding to their uncoated counterparts. Thus, the addition of a polyurea coating delayed the onset of failure allowing the unreinforced configurations to sustain more deflection before they reached their peak loads. Unexpectedly, failure results indicate that the coated configurations sustain anywhere from two to four times as much uplift force when compared to their uncoated counterparts. The energy absorption is even greater.

Surprisingly, as shown in Tables 1, 2 and 3, the net strain energy to Pmax shows that it takes almost eight times more energy to bring a coated configuration to the peak load as compared to that required to bring an uncoated configuration to the same condition. Even when the configuration is reinforced with a metal tie, the strain energy associated with the coated configuration is three times that which is associated with their uncoated counterparts.

Significantly, the polyurea coating strengthened both the unreinforced and reinforced configurations by dramatically increasing the amount of work/energy required to pull them apart.

The polyurea coating of the stud-top plate-rafter configuration in combination with a hurricane tie substantially enhances the structural performance when the hurricane tie alone does little to strengthen the uncoated joint.

In contrast to existing metal hurricane ties that are designed to withstand a specific loading, a polyurea coating provides substantial reinforcement and strengthening of the building structure from damage due to high shear force winds which produce roof upload forces. Retrofitting existing housing and reinforcing newly framed structures with polyurea in the coastal and central areas of the United States will substantially mitigate damage from hurricane and tornadoes. The polyurea coating provides an added advantage that members and joints can be protected from a multitude of threats such as corrosion due to moisture and damage due to flooding.

REFERENCES

American Society for Testing and Materials, 1998. Standard Test Methods for Mechanical Fasteners in Wood. ASTM D1761-06.

What is claimed is:

1. A wood framing structure comprising:

a first wood structural member having a first surface;

a second wood structural member having a second surface;

a connection by a connection means between a portion of the first wood structural member and a portion of the second wood structural member, wherein the first wood structural member and the second wood structural member have an overlapping intersection and form a third surface which is obscured by the connection; and a coating consisting essentially of a two-component polyurea, and wherein the coating substantially covers at least 60% of the overlapping intersection between the first and the second wood structural members, and wherein the coating substantially covers the first wood structural member and the second wood structural member at least about 1.0 cm from the intersection of the first and second wood structural members.

2. A wood framing structure according to claim 1, wherein the coating has an thickness of about 0.38 mm to about 2.5 mm.

3. A wood framing structure according to claim 1, wherein the wood framing structure comprising wood structural members withstands an at least 200% greater load in tension than the wood framing structure without the coating.

4. A wood framing structure according to claim 1, wherein the wood framing structure is a roof truss comprising a geometric shape, comprising at least a first and a second wood structural member, the first and the second wood structural member each comprise at least one member selected from the group consisting of pine, spruce, and fir, the connection means comprises a fastener, the coating consists essentially of a said two-component polyurea, the coating at the intersection between the first and the second wood structural members and the fastener substantially covers at least an average of 5 mm from the overlapping intersection between the first and the second wood structural members and fastener.

5. A wood framing structure according to claim 1, wherein the connection has at least a 200% increase in strain energy compared to the uncoated connection.

6. A wood framing structure according to claim 1, wherein the coating has a tensile strength from about 14 MPa to about 45 MPa.

7. A wood framing structure according to claim 1, wherein the wood structural member is a member selected from the group consisting of stud, joist, beam, sole plate, double top plate, and rafter.

8. A method for increasing the net deflection of structural framing members before failure of a connection between a first wood framing member and a second wood framing member in a wood framing structure, comprising:

connecting a portion of a first wood framing member and a portion of a second wood framing member by a connection means to form a connection, wherein the first and second wood framing members have an overlapping intersection and form a third surface which is obscured by the connection, applying a coating to the connection of the first and second wood framing members of at least 60% of the length of the connection between the first and the second wood framing members with a coating liquid consisting essentially of a two-component polyurea to form a covering.

9. A method according to claim 8, wherein the covering has a thickness of at least 1.0 mm over the connection of said first and said second wood framing members within at least 5 mm of the connection.

10. A method according to claim 8, wherein the strain energy absorption of the connection between said first and said second wood framing members increases by at least 200 percent.

11. A method according to claim 8, wherein the covering comprises applying the coating liquid to the connection of said first and said second wood framing members by an application means selected from the group consisting of spraying, brushing and extruding, substantially coating all exposed surfaces of the connection of the wood members attached to at least one other wood member.

12. A method according to claim 8, wherein the coating liquid is applied to the wood framing structure after connecting the first wood framing member and the second wood framing member.

13. A method according to claim 8, wherein the covering has a tensile strength from at least about 14 MPa to about 45 MPa.

14. A method according to claim 8, wherein the wood framing member is a member selected from the group consisting of stud, joist, beam, sole plate, double top plate, and rafter.

* * * * *